US008063325B2

(12) United States Patent
Sung et al.

(10) Patent No.: US 8,063,325 B2
(45) Date of Patent: Nov. 22, 2011

(54) KEYPAD ASSEMBLY

(75) Inventors: Fu-Hsin Sung, Taipei Hsien (TW); Yi-Hua Wang, Taipei Hsien (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 403 days.

(21) Appl. No.: 12/405,550

(22) Filed: Mar. 17, 2009

(65) Prior Publication Data

US 2010/0072047 A1 Mar. 25, 2010

(30) Foreign Application Priority Data

Sep. 19, 2008 (CN) ..... 2008 1 0304556

(51) Int. Cl.
*H01H 9/00* (2006.01)

(52) U.S. Cl. ..... 200/314; 200/512

(58) Field of Classification Search ..... 200/314
See application file for complete search history.

(56) References Cited

U.S. PATENT DOCUMENTS

| | | | | |
|---|---|---|---|---|
| 6,573,463 | B2 * | 6/2003 | Ono | 200/5 A |
| 6,860,612 | B2 * | 3/2005 | Chiang et al. | 362/29 |
| 7,271,360 | B2 * | 9/2007 | Kobayashi | 200/314 |
| 7,671,290 | B2 * | 3/2010 | Chen et al. | 200/314 |
| 7,897,889 | B2 * | 3/2011 | Chikahisa et al. | 200/314 |

* cited by examiner

*Primary Examiner* — Elvin G Enad
*Assistant Examiner* — Lisa Klaus
(74) *Attorney, Agent, or Firm* — Altis Law Group, Inc.

(57) ABSTRACT

An exemplary keypad assembly includes: a printed circuit board (PCB) comprising a plurality of fixed contact points formed thereon, an elastic sheet disposed on the PCB, the elastic sheet comprising a base and many switches fixed on the base above the fixed contact points correspondingly; many key buttons, each key button comprising a main portion, and a pressing portion extending downward from the main portion; a light shielding sheet defining a plurality of through holes, the light shielding sheet integrally formed with the key buttons, the key buttons respectively passing through each of the through holes of the light shield sheet. The light shielding sheet with the key buttons is disposed above the elastic sheet, each pressing portion of each key button corresponding to each switch. The keypad assembly has a thin configuration due to a combination configuration of the light shielding sheet and the key buttons.

11 Claims, 3 Drawing Sheets

KEYPAD ASSEMBLY

BACKGROUND

1. Technical Field

The present disclosure relates to keypad assemblies, and particularly, to a keypad assembly for use in portable electronic device.

2. Description of the Related Art

With the development of wireless communication and information processing technologies, portable electronic devices, such as mobile telephones and personal digital assistants, are now in widespread use. These electronic devices enable consumers to enjoy high technology services, almost anytime and anywhere. The keypad assembly as an input terminal has been an indispensable member of portable electronic devices.

A typical keypad assembly for a given electronic device includes a plurality of key buttons, a light shielding sheet, an elastic sheet, a printed circuit board (PCB), a light source and a light guide plate. However, the typical keypad assembly is unduly bulky, complicated, and therefore costly to manufacture.

What is needed, therefore, is a new keypad assembly to overcome the above-described shortcomings.

BRIEF DESCRIPTION OF THE DRAWINGS

Many aspects of the present keypad assembly can be better understood with reference to the following drawings. The components in the drawings are not necessarily drawn to scale, the emphasis instead being placed upon clearly illustrating the principles of the present method. Moreover, in the drawings, like reference numerals designate corresponding parts throughout the several views.

DETAILED DESCRIPTION OF THE EMBODIMENTS

Figure 1:
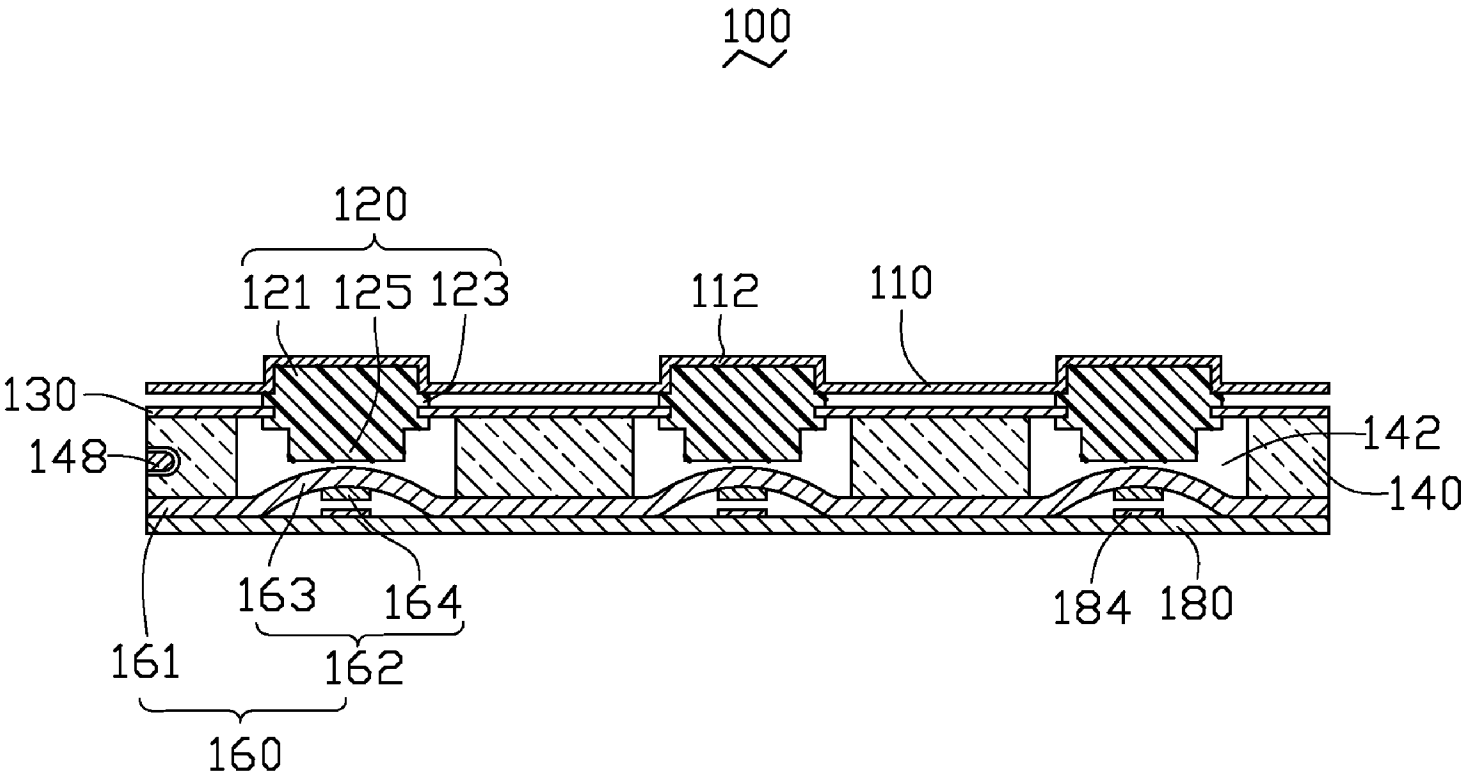
FIG. 1 is a schematic, side cross-sectional view of a keypad assembly according to a first exemplary embodiment of the present disclosure.

Referring to FIG. 1, a keypad assembly 100 in accordance with a first exemplary embodiment includes a plurality of key buttons 120, a light shielding sheet 130, a light guide plate 140, a light emitting diode 148, an elastic sheet 160, and a PCB 180. The keypad assembly 100 is suitably assembled within a portable electronic device (not shown), such as the mobile phone, the personal digital handset, or the like to provide input to the portable electronic device.

Each of the key buttons 120 includes a main portion 121, a pressing portion 125 extending downward from the main portion 121, and a connecting ring portion 123 extending out from side surfaces of the main portion 121. The main portion 121 is substantially a column in shape. The light shielding sheet 130 is substantially a flat sheet which defines a plurality of circular through holes (not labeled). The light shielding sheet 130 and the key buttons 120 are integrally formed by an inserted molding method, such that an inner surface of the circular through hole of the light shield sheet 130 is inserted into the connecting ring portion 123 of the key buttons 120.

Thus, the light shielding sheet 130 and the key buttons 120 cooperatively define a keypad (not labeled). The key buttons 120 are made of materials having a good light transmission rate, such as rubber, for allowing light to pass through. The light shielding sheet 130 is made of opaque materials, such as metallic materials, for preventing the light emitted from the light emitting diode 148 from emitting out except through the key buttons 120.

The light guide plate 140 defines a plurality of through holes 142 according to the key buttons 120. The light guide plate 140 is positioned underneath the light shielding sheet 130 with the key buttons 120, and the pressing portions 125 of the key buttons 120 positioned in the corresponding through holes 142. The light emitting diode 148 is disposed adjacent to a side surface of the light guide plate 140. A material of the light guide plate 140 can be selected from one of polymethyl methacrylate (PMMA), polycarbonate (PC), and any other suitable transparent resin material.

The elastic sheet 160 includes a base 161 and a plurality of switches 162 fixed on the base 161 corresponding to the pressing portions 125 of the key buttons 120. In this embodiment, each switch 162 includes an elastic dome 163 extending outward from the base 161 towards the pressing portion 125, and an electrically conductive contact member 164 formed at an inner surface of the dome 163. Each of the domes 163 has a hemispherical shape. The elastic sheet 160 is positioned underneath the light guide plate 140, and the domes 163 of the elastic sheet 160 are also positioned into the corresponding through holes 142 apart from the pressing portions 125 of the key buttons 120.

In this embodiment, the keypad assembly 100 may further includes a cover 110 positioned on the key buttons 120 and the light shielding sheet 130. The cover 110 includes a plurality of keycaps 112 for covering the key buttons 120 correspondingly. Light transmission configurations (not shown) in shape of letters, numerals and/or symbols are formed in the keycap 112 corresponding to the key buttons 120, for allowing light to pass through. In an alternatively embodiment, the cover 110 can be only comprised of the keycaps 112 fixed on the key buttons 120. In another alternatively embodiment, if the key buttons 120 has the light transmission configurations formed thereon, the cover 110 may be omitted.

The PCB 180 includes a plurality of fixed contact points 184 formed on an upper surface of the PCB 180. The elastic sheet 160 is attached to the upper surface of the PCB 180, each of the fixing contact points 184 corresponding to each of the electrically conductive contact members 164 of each switch 162. When a user presses any one key button 120, the corresponding pressing portion 125 of the key button 120 presses the corresponding dome 163. Then, the conductive contact member 164 of the pressed dome 163 comes in electrical contact with a corresponding fixed contact point 184 of the PCB 180, so that an electronic signal is formed/generated. Light emitted from the light emitting diode 148 can be coupled into the light guide plate 140 through the side surface of the light guide plate 140, and finally illuminating the light transmission configurations of the keycap 110. When the key button 120 is released, it returns to its original state due to the elasticity of the key button 120.

It should be pointed out that the main portions 121 of the key buttons 120 may be other shapes, and the through holes of the light shielding sheet 130 may have a shape to match with the main portion 121. The connecting ring portion 123 may be omitted, if the inner surface of the circular through hole of the light shield sheet 130 is directly inserted into a part of the main portion 121 of the key buttons 120.

Figure 2:
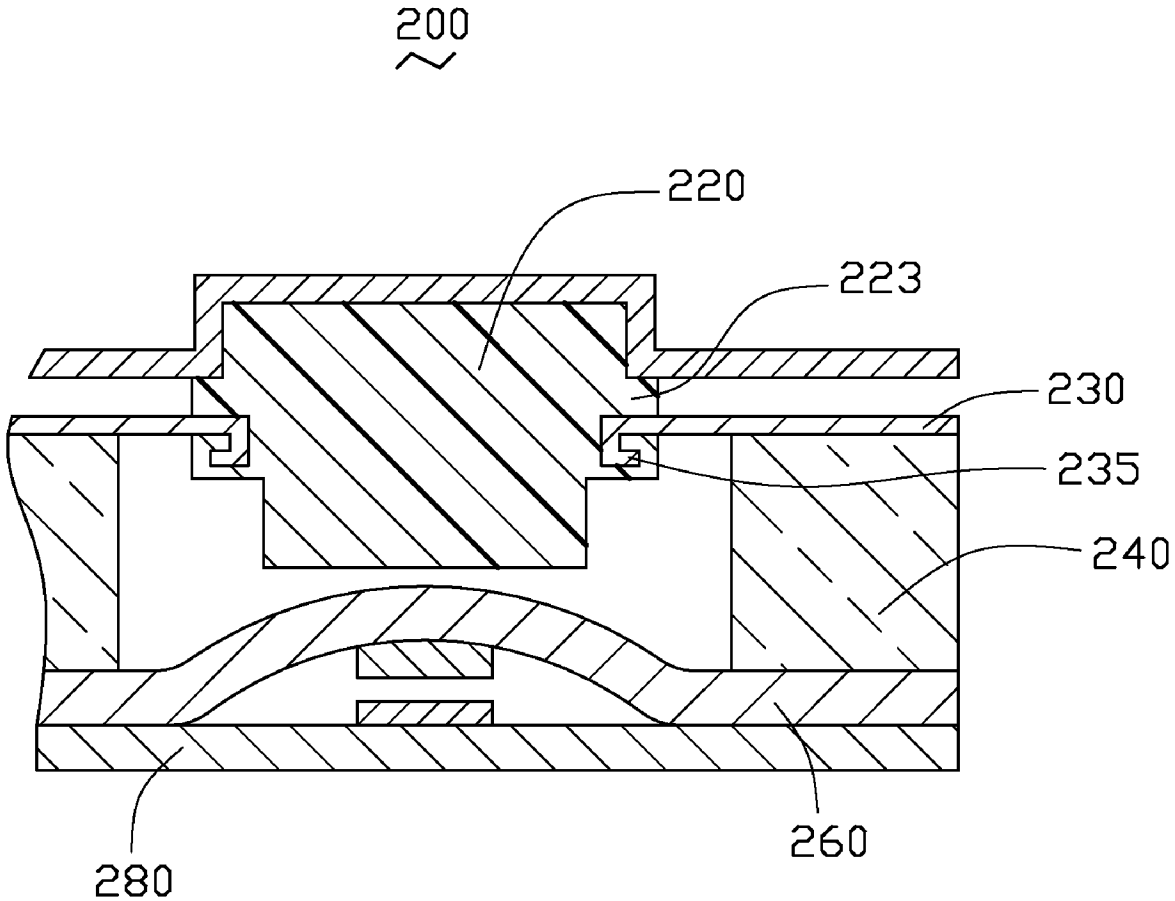
FIG. 2 is a schematic, partial, side cross-sectional view of a keypad assembly according to a second exemplary embodiment of the present disclosure.

Referring to FIG. 2, a keypad assembly 200 in accordance with a second exemplary embodiment includes a plurality of key buttons 220, a light shielding sheet 230, a light guide plate 240, an elastic sheet 260, and a PCB 280. The keypad assembly 200 is similar as principle to the keypad assembly 100 of the first exemplary embodiment, except that the key buttons 220 and the light shielding sheet 230 are different from those of the keypad assembly 100.

In this embodiment, the light shielding sheet 230 defines a plurality of circular through holes (not labeled) and at least one hooking member 235 extending from a periphery of an inner surface of each of the circular through holes. The light shielding sheet 230 and the key buttons 220 are integrally formed by inserted molding method, such that the at least one hooking member 235 of the light shielding sheet 230 is inserted into a connecting ring portion 223 of the key buttons 220. Thus, a bonding strength between the key buttons 220 and the light shielding sheet 230 is increased.

Figure 3:
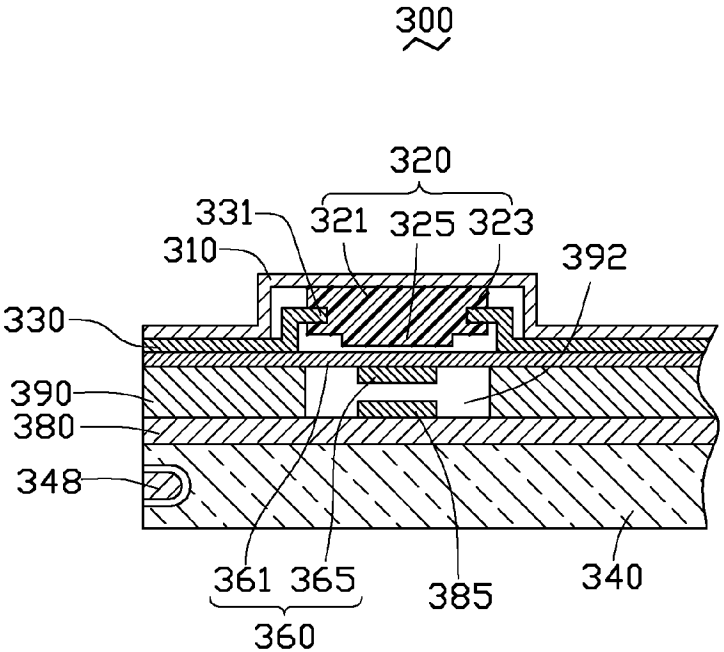
FIG. 3 is a schematic, partial, side cross-sectional view of a keypad assembly according to a third exemplary embodiment of the present disclosure.

Referring to FIG. 3, a keypad assembly 300 in accordance with a third exemplary embodiment includes a cover 310, a plurality of key buttons 320, a light-shielding sheet 330, a light guide plate 340, a light source 348, an elastic sheet 360, a PCB layer 380, and a supporting plate 390. The light source 348 is disposed adjacent to a side surface of the light guide plate 340. The PCB layer 380 is positioned on the light guide plate 340. The PCB layer 380 has a plurality of fixed contact points 385 formed on its upper surface. The supporting plate 390 defines a plurality of through holes 392, and is positioned on the PCB layer 380. The fixed contact points 385 are positioned in the through holes 392 correspondingly. The elastic sheet 360 has a base 361 and a plurality of electrically conductive contact members 365 (switches) formed on its bottom surface of the base 361. The elastic sheet 360 is disposed on the supporting plate 390, and the conductive contact members 365 are positioned in the through holes 392 facing the conductive contact members 385. The conductive contact members 365 are spaced apart from the fixed contact points 385. All of the elastic sheet 360, the supporting plate 390, and the PCB layer 380 are made of materials having a good light transmission rate for allowing light pass through, such as transparent resin materials.

Each of the key buttons 320 includes a main portion 321, a pressing portion 325 extending downward from the main portion 321, and a connecting ring portion 323 extending out from side surfaces of the main portion 321. In this embodiment, the light shielding sheet 330 defines a plurality of circular through holes (not labeled) and forms a stepped rim 331 extending from a periphery of each of the circular through holes away from the light guide plate 340. The light shielding sheet 330 and the key buttons 320 are integrally formed by inserted molding method, such that the stepped rim 331 of the light shielding sheet 330 is inserted into the connecting ring portion 323 of the key buttons 320. Thus, the light shielding sheet 330 and the key buttons 320 cooperatively forms a keypad (not labeled). The cover 310 is positioned on the key buttons 320 and the light shielding sheet 330.

When a user pressed any one key button 320, the pressing portion 325 of the key buttons 320 press the elastic sheet 360. The corresponding conductive contact member 365 of the pressed elastic sheet 360 comes in electrical contact with a corresponding conductive contact member 385 of the PCB layer 380. Light emitting from the light emitting diode 348 can be coupled into the light guide plate 340 through the side surface of the light guide plate 440, and finally illuminating light transmission configurations formed in the cover 310.

The keypad assemblies 100, 200, 300 have a thin configuration due to a combination configuration of the light shielding sheet and the key buttons.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. A keypad assembly comprising:

a printed circuit board comprising a plurality of fixed contact points formed thereon, an elastic sheet disposed on the printed circuit board, the elastic sheet comprising a base and a plurality of switches fixed on the base above the fixed contact points correspondingly;

a plurality of key buttons, each key button comprising a main portion, a connecting ring portion extending out from side surface of the main portion, and a pressing portion extending downward from the main portion;

a light shielding sheet defining a plurality of through holes, the light shielding sheet integrally formed with the key buttons, and comprising at least one hooking member extending from a periphery of an inner surface of each of the through holes, the at least one hooking member inserted into the connecting ring portion, the key buttons respectively passing through each of the through holes of the light shielding sheet, wherein the light shielding sheet with the key buttons is disposed above the elastic sheet, each pressing portion of each key button corresponding to each switch.

2. The keypad assembly of claim 1, wherein an inner surface of each of the through holes of the light shielding sheet inserted into the connecting ring portion of the key buttons correspondingly.

3. The keypad assembly of claim 2, wherein light shielding sheet further comprises a stepped rim extending from a periphery of each of the through holes thereof, the stepped rim inserted into the connecting ring portion of the key buttons.

4. The keypad assembly of claim 1, further comprising a light guide plate defining a plurality of through holes therein according to the key buttons, the light guide plate positioned between the light shielding sheet and the elastic sheet, pressing portions of the key buttons inserted into the corresponding through holes thereof, and switches of the elastic sheet inserted into the corresponding through holes thereof.

5. The keypad assembly of claim 4, further comprising a light source disposed adjacent to a side surface of the light guide plate.

6. The keypad assembly of claim 1, wherein each of the switches comprises an elastic dome extending outward from the base, and an electrically conductive contact member formed at an inner surface of the dome.

7. The keypad assembly of claim 1, further comprising a cover positioned on the key buttons and the light shielding sheet, the cover comprising a plurality of keycaps for covering the key buttons correspondingly.

8. The keypad assembly of claim 7, wherein letters, numerals and/or symbols are formed in the plurality of keycaps corresponding to the key buttons, for allowing light to pass through.

9. The keypad assembly of claim 1, further comprising a light guide plate disposed under the printed circuit board, and a light source disposed adjacent to a side surface of the light guide plate.

10. The keypad assembly of claim 9, further comprising a supporting plate positioned on the printed circuit board, the supporting plate defining a plurality of through holes, the elastic sheet disposed on the supporting plate, and the switches of the elastic sheet are inserted into the through holes of the supporting plate corresponding to the fixed contact points of the printed circuit board.

11. The keypad assembly of claim 10, wherein the elastic sheet, the supporting plate, and the printed circuit plate are made of transparent resin materials.

* * * * *